United States Patent [19]

Herbert

[11] 3,966,592

[45] June 29, 1976

[54] DEWATERING AND CLASSIFYING APPARATUS

[76] Inventor: Daniel H. Herbert, 138 Ainsworth Ave., East Brunswick, N.J. 08816

[22] Filed: Mar. 20, 1975

[21] Appl. No.: 560,560

[52] U.S. Cl. ..... 209/462; 209/500; 210/527

[51] Int. Cl.[2] ..... B03B 5/50

[58] Field of Search ..... 209/461, 462, 464, 500; 210/83, 523, 525, 527

[56] References Cited

UNITED STATES PATENTS

| | | | |
|---|---|---|---|
| 849,379 | 4/1907 | Dorr | 210/527 X |
| 1,215,345 | 2/1917 | Clark | 209/462 |
| 1,860,811 | 5/1932 | Little et al. | 209/462 X |
| 2,180,574 | 11/1939 | Wood | 209/462 X |
| 2,191,744 | 2/1940 | Scott | 209/462 X |
| 2,647,631 | 8/1953 | Scott | 209/462 |
| 2,720,972 | 10/1955 | Hollingsworth | 209/462 |
| 3,807,558 | 4/1974 | Hamm | 209/500 X |

*Primary Examiner*—Frank W. Lutter
*Assistant Examiner*—Ralph J. Hill
*Attorney, Agent, or Firm*—Paul & Paul

[57] ABSTRACT

Dewatering apparatus is provided, for use in the treatment of particulate material in water, particularly suspensions of sand in water. The apparatus is also provided with means for classifying sand or like particulate material by size. The apparatus employs a sloped trough extending upwardy from a well having sand and water therein, and with a longitudinally moveable rake being provided, with a particularly novel mechanized raking motion, preferably hydraulically operated. The classifying is done by varying the inflow and consequently the overflow of water through the apparatus, varying the water flow from spray pipes extending along side of the discharge trough, or by speeding up the operation of the apparatus.

12 Claims, 10 Drawing Figures

DEWATERING AND CLASSIFYING APPARATUS

BACKGROUND OF THE INVENTION

In the processing of fine materials, such as various sands, brown limestone and various ores, it is usually necessary to clean and dewater such materials and sometimes it is required that they be classified as to particle size. Such treatment in the past has been carried out in apparatus such as screw washers, sand drags, cyclones or settling tanks, or in apparatus employing moveable rakes. The screw washer or rake-employing apparatus in general has employed an elongated trough, in which the screw or rakes are positioned. The well usually contains water and sand in the suspension, and the trough embodies a discharge slope. The rake is usually moveably carried, either in a continuous fashion, as on a conveyor system for movement through the well and up the discharge slope, or in instances in which the rake has not been continuous, its movement has been actuated by mechanical mechanisms that lift the rake in a motion whereby it remains substantially parallel to the discharge slope, but moves into and out of submersion in the sand-water suspension.

Such motions of rakes are very often unsatisfactory, particularly when the sand is fine in particle size and approaches a suspension in the water, in that such systems often create turbulence which is sufficiently severe to interfere with optimum performance of the apparatus. Also in the prior art, various baffle arrangements have been suggested, that have not been entirely satisfactory.

THE PRESENT INVENTION

The present invention is directed to providing dewatering apparatus that utilizes a sloped discharge of the trough type, in which a rake is operable for discharging sand from the water in the well, conveying the sand upwardly out of the well, across the discharge chute, to another receiving apparatus. The present invention is of apparatus that is much less bulky than a screw conveyor, and which employs considerably less complex and therefor less expensive rake blades or paddles rather than screw fliting, for example. The apparatus of the present invention therefore employs rake blades. The drive means for the rake employs a cylinder drive means at that end of the rake nearest its discharge, which also comprises the upward end of the apparatus. This cylinder drive means is generally operable in a direction parallel to the sloped discharge surface, and in particular embodiment employs a hydraulic cylinder for driving the upper end of the rake while guiding such movement by an appropriate guiding mechanism. The lower end of the rake above the well bottom is free to be moved in a parallel fashion along the discharge slope or chute, as driven by the upper cylinder type driving mechanism, but upon reaching an upper position, the rake is raised out of the water by means of another cylinder type of drive means that is operable in a direction generally transverse to the slope of the discharge means, for moving the lower end of the rake that is along the chute, away from the chute, whereupon it may be returned by actuation of the drive cylinder that has originally driven the rake upwardly along the sloped chute. During such returning motion of the rake, appropriate guide means are provided for guiding the lower end of the rake in a generally lateral direction, followed by re-activation of the cylinder type drive means at the lower end of the rake for drawing the lower end of the rake back into the well again, in which position the rake (main portion of the rake, not the rake extension, if reference is made to the embodiment of FIG. 9) will again be disposed generally parallel to the sloped chute, with the cycle then being repeated over and over again. The classifying is accomplished by adjustment of flow of water into the apparatus and overflow out of the well to carry out fines and leave larger particles to be delivered up the chute, or by the use of water inlet pipes along sides of the chute that contain water the flow of which may be adjusted by suitable valving arrangements or the like for varying the inflow of water to the piping, such inflow of water serving not only to direct a downstream flow of water for directing a flow of water outwardly from between rake blades, but to classify the particulate material being discharged on the basis of its weight, size, etc. that is basically responsive to the degree of resistance of such particles to water flow from the pipes. A third way to classify comprises speeding up the operation of the apparatus that effects a stirring or turbulence and washes out some of the fines.

Accordingly, it is a primary object of this invention to provide a novel dewatering apparatus for particulate material, and most particularly for sand.

It is another object of this invention to provide a novel dewatering device that also employs a classification feature.

It is a further object of this invention to accomplish the above objects, wherein a moveable rake is utilized, and providing a novel smooth movement for such rake caused by hydraulic cylinders rather than by abrupt mechanisms.

It is another object of this invention to make a sand dewatering and classifying apparatus that is more efficient than the screw classifier, and that because of its reduced weight, can be less expensive than the usual screw classifier with its necessarily heavy drive systems that can result in drive system breakage when one desiring to use a screw classifier trys to maximize its capacity.

It is another object to avoid some of the deficiencies of prior rakes, and providing a rake that does not touch the slope or chute, as it moves upwardly thereof, such that, when the rake is moving along the chute, it moves against the sand, not against metal.

Other objects and advantages of the present invention will be readily apparent to those skilled in the art from the reading of the following brief descriptions of the drawing figures, detailed description of the preferred embodiment, and the appended claims.

DESCRIPTIONS OF THE PREFERRED EMBODIMENTS

Figure 1:
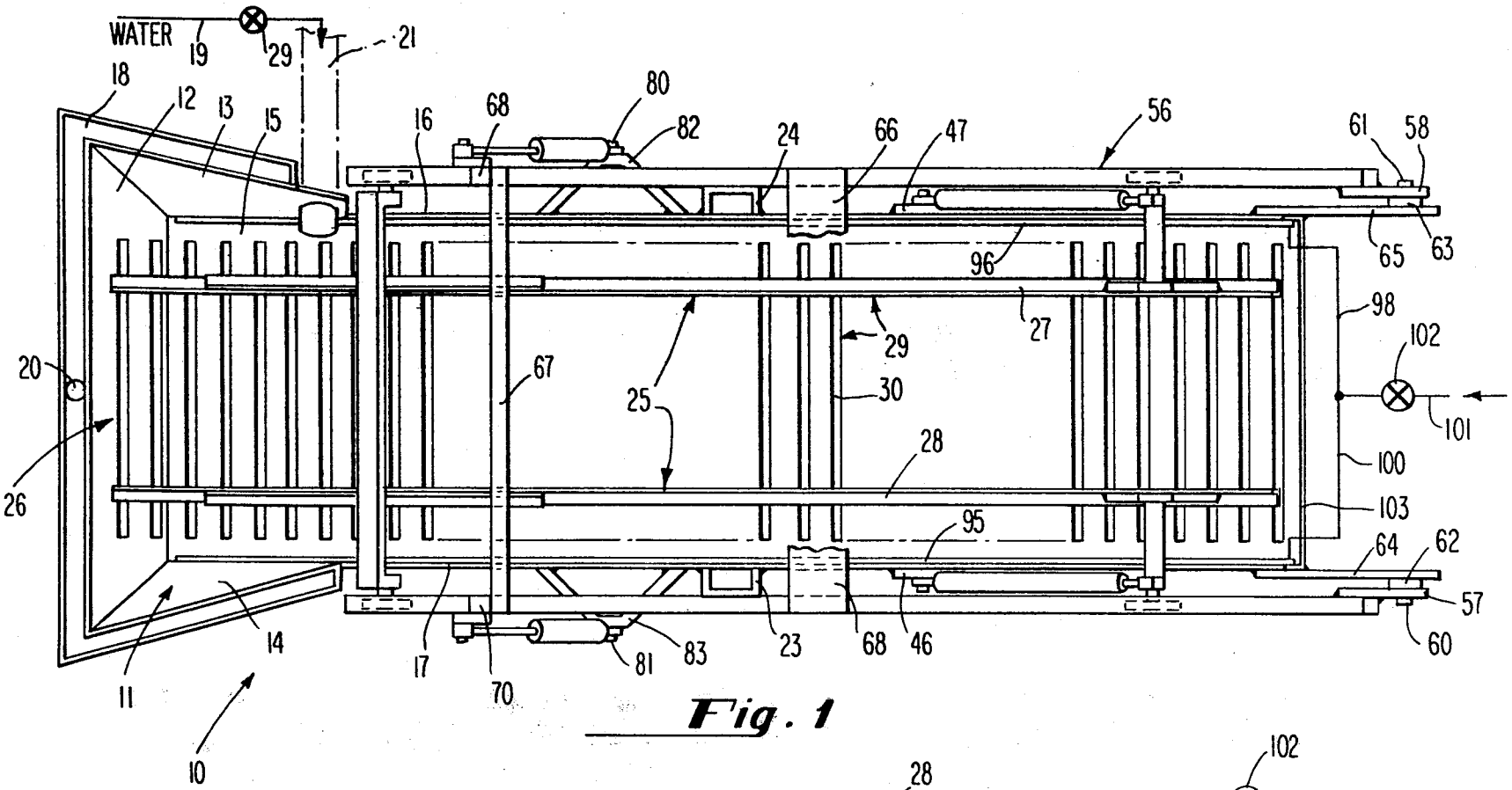
FIG. 1 is a top plan view of the dewatering apparatus of this invention.

Referring now to the drawings in detail, reference is first made to FIG. 1, wherein the apparatus 10 is generally illustrated as comprising a well 11 at the left end of the illustration of FIG. 1, the well 11 having a rear wall 12, sidewalls 13 and 14 and a sloped lower wall 15 that comprises the lower end of the discharge chute, and that taken together with sidewall portions 16 and 17 comprise a discharge chute or trough-like arrangement extending out of the well 11.

Figure 4:
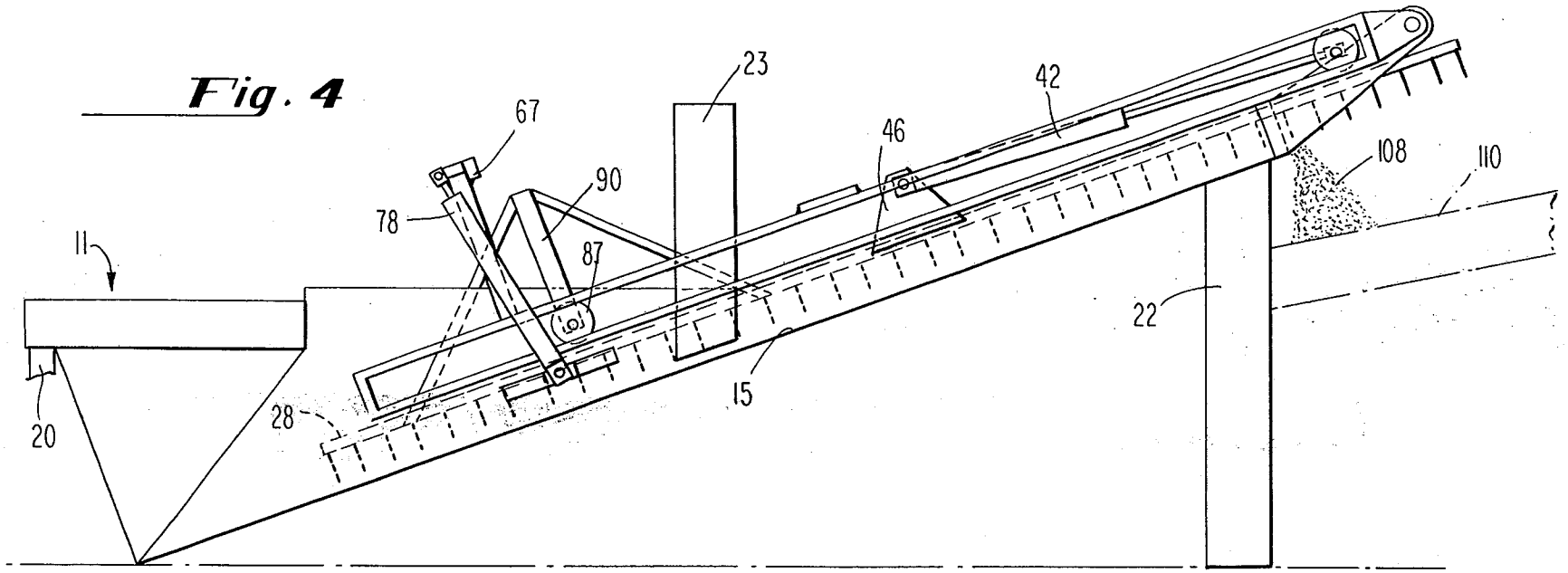
FIG. 4 is a view similar to that of FIGS. 2 and 3, without the broken-away illustration, but wherein the rake has been lifted upwardly, parallel to the sloped bottom surface, and has completed its upward parallel movement, and is illustrated discharging particulate material from the upper end of the sloped discharge.

A water overflow trough 18 is provided around the upper end of the walls 12, 13, and 14, for delivery of water that overflows thereinto, to a discharge line 20 as illustrated in FIG. 4.

An inlet supply line 21, generally for supplying a composite supply of water and sand or other particulate material into the well 11, is also provided, extending through the wall 13, as illustrated in FIg. 1, with water being provided at supply line 19, having an adjustable control valve 29 therein.

The chute 15 is supported at the right end by suitable structural support members 22. Upstanding supports 23 and 24 are also provided, secured to sidewalls 17 and 16, respectively, and they serve to provide a guiding function for the guide means therepast, as will be apparent hereinafter. A moveable elongate structure generally designated 25 is provided for the rake 26, in the form of a pair of rails 27, and 28, and attached components that will be described hereinafter, with the rails 27 and 28 having a plurality of planar rake blades 30 suitably secured thereto, either by weldments or other suitable fastening means. The rake blades 30 may be of hard rubber, plastic, or metal construction, as desired, and will be sufficiently rigid to accomplish their purposes in accordance with the disclosure hereof. The rake blades 30 will generally have their lower ends disposed slightly above the sloped discharge surface 15, when the rake is in a lowered raking position, generally parallel to the surface of the discharge chute 15.

Figure 7:
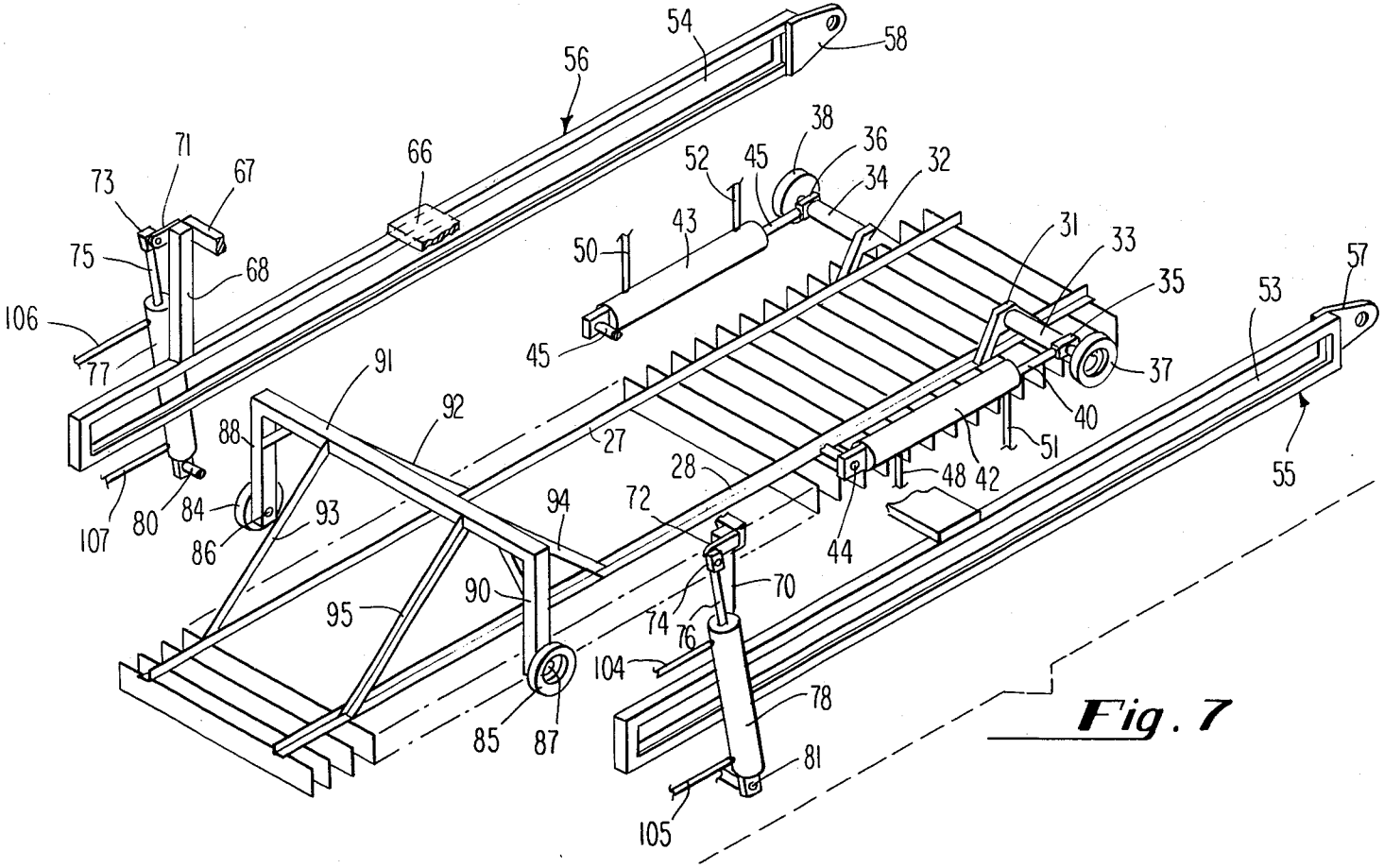
FIG. 7 is an exploded perspective view of the rake assembly, track assembly, and related components of this invention.

At the right-most end of FIG. 1, and shown with particularity in FIG. 7, there are provided a pair of mounting fixtures 31 and 32, welded or otherwise suitably secured to the respective rails or angle irons 28 and 27, and standing upwardly thereof. Mounting posts 33 and 34 are suitably secured to the fixtures 31 and 32, respectively, by mounting means or the like. Suitable pivot connectors 35 and 36 are pivotally carried at ends of respective posts 33 and 34, with rotatable guide wheels 37 and 38 being rotatably carried outwardly of the pivot connectors 35 and 36, respectively. The pivot connectors 35 and 36 each connect outer ends of rods 40, 41 of preferably hydraulic cylinders 42, 43. The hydraulic cylinders are of generally conventional construction, suitably sized to accomplish the purposes of this invention, and have their lower ends pivot-mounted at 44, 45, respectively on support struts 46, 47, that in turn, are carried by trough sidewalls 17, 16, respectively. The cylinders 42 and 43 are of the double-acting type, being provided with discharge or extension fluid inlets 48, 50, and retraction fluid inlets 51, and 52. The guide wheels 37 and 38 are guidingly rotatable in tracks 53 and 54 of corresponding guides 55 and 55. The guides 55 and 56 are pivot-mounted at their right ends by means of pivot ears, 57 and 58 suitably carried thereby, that in turn, fit over post or shaft ends 60, 61, against shoulders 62, and 63 as illustrated in FIG. 1, and that in turn, project outwardly from upwardly angled extensions 64, and 65 of the trough or discharge chute sidewalls 17 and 16, respectively. The guides 55 and 56 are connected by a suitable connecting support member 66 welded or otherwise suitably secured thereto, and are also connected by a connecting support member 67 extending between upstanding posts 68 and 70 that extend upwardly from upper portions of low ends of the guides 55 and 56. A pair of links 71 and 72 are fixedly carried by the posts 68 and 70, respectively, and in turn have pivot pin connectors 73 and 74 pivotally carried thereby, that in turn connect cylinder rods 75 and 76 of another pair of double-acting, preferably hydraulic (although possibly pneumatic, if desired) cylinders 77 and 78. These cylinders 77 and 78 are pivot-mounted at their lower ends at 80 and 81 to suitable cylinder support structures 82 and 83, that in turn are carried by lower portions of the sidewalls 17 and 16 that comprise the sidewalls of the well 11. A pair of guide wheels 84 and 85 allow guided rotatable movement in tracks 53 and 54 of guides 55 and 56, respectively.

The guide wheels 84 and 85 are shaft-mounted at 86 and 87, for rotatable movement thereon, the shafts 86 and 87 being carried by downwardly extending posts 88 and 90 of a suitable horizontal support member 91 that, in turn, is carried by a suitable angle-iron support 92, 93, 94, and 95, rigidly affixed to the rails 27 and 28 as illustrated.

Figure 6:
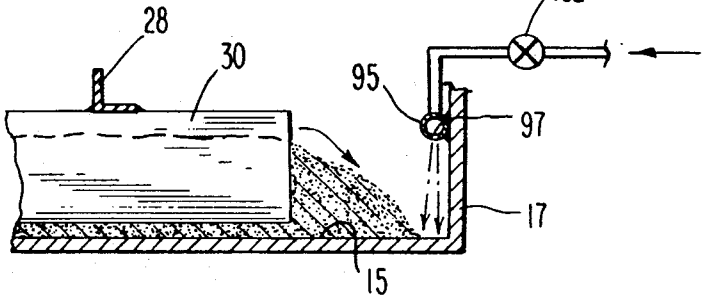
FIG. 6 is an enlarged fragmentary sectional view taken generally along the line VI—VI of FIG. 3, and wherein the classifying means in the form of a spray pipe is illustrated, as is a detail of a rake blade.

A pair of water inlet tubes 95, 96 are provided, carried by trough or chute sidewalls 17 and 16, respectively, on inner surfaces thereof, as illustrated in FIGS. 1 and 6, preferably throughout the length of the well and discharge chute, with the inlet pipes 95 and 96 being provided with spray outlet orifices or nozzles 97. The orifice 97 is illustrated as opening generally downwardly in FIG. 6, but it will be understood that it could open at any desired angle, sideways, or the like, for spraying water onto the sand or other particulate material therein.

The nozzles 97 function to direct the flow of water downwardly of the chute, thereby providing a flow path for directing water outwardly from between the paddles, toward the side wall 17, for example, and eventually down the chute into the well.

To this end, a great number of such spray orifices 97 exist along the length of the inlet tubes 95 and 96, which, in the aggregate also perform a classifying function in providing a certain resistance to particulate material being conveyed up the chute surface 15, thereby facilitating the classifying of the particulate material to some extent on the basis of its size and weight, as functions of the ability to withstand resistance of the inflow of water through the tubes, 95, 96. Larger, heavier particles will better withstand the force of flow of water emanating from the various holes or openings, nozzles or the like in tubes 95, 96, and will be delivered therepast, with the fines being washed downwardly, to be delivered through the overflow 18, and outwardly of the well through the overflow outlet 20. Thus, the principal function of the spray orifices 97 is to keep the channels along the sides of the apparatus, as illustrated in FIG. 6, for example, open, and for facilitating a downward flow of water, although a certain amount of classifying is also provided by the nozzles or orifices 97 as aforesaid.

The delivery piping of water to the tubes 95, 96 is connected by connecting tubes 98, 100 to preferably a single inlet 101, that is provided with an adjustable valve 102 in the line thereof, for controlling the volume of flow of water there-through, depending upon the setting of the valve 102. Thus, a faster flow of water there-through, that will in turn dispense water with a greater flow, and spray it with a greater velocity through the orifices 97 of the tubes 94 and 96, will result in the delivery of larger, heavier particles at the upper end 103 of the chute, whereas a lower flow rate through the nozzles or openings 97 will allow finer particles to be delivered to the upper end 103 of the discharge chute, also.

Figure 3:
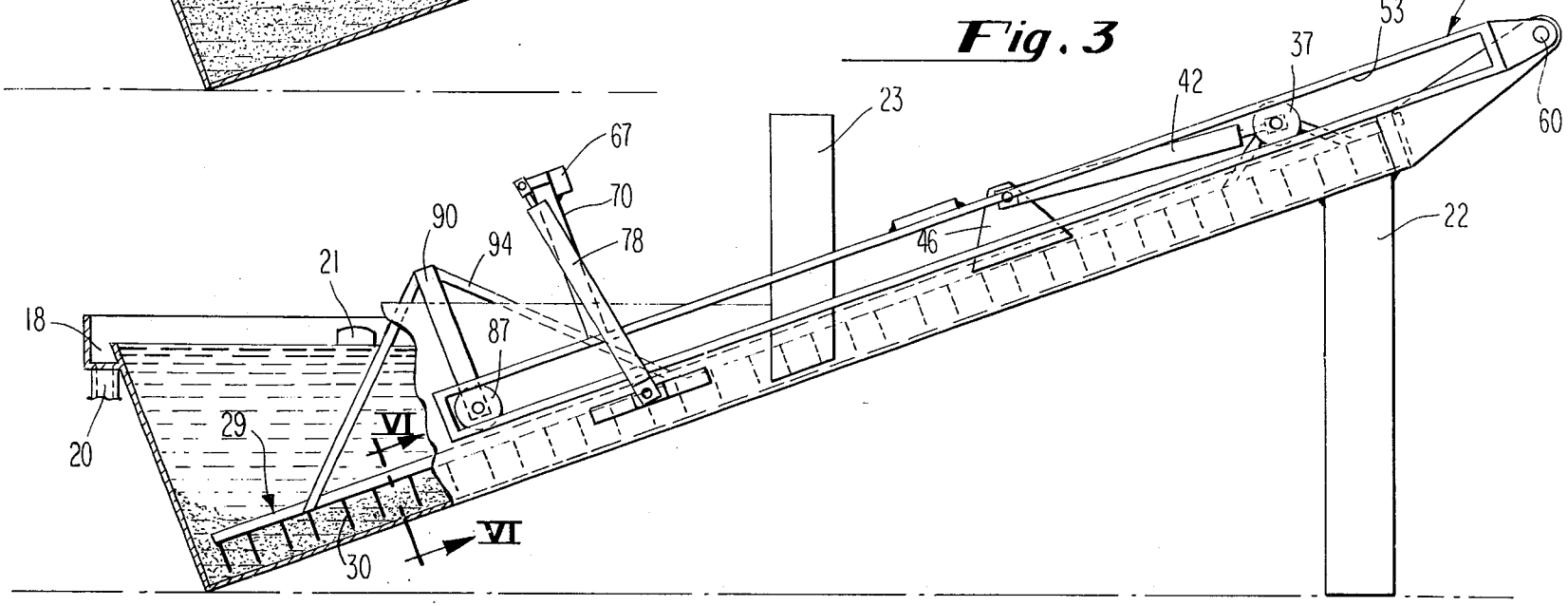
FIG. 3 is a view generally similar to that of FIG. 2, but wherein the rake is in position in the well, generally parallel to the sloped bottom surface thereof, ready to be actuated for upward movement of the rake along the sloped discharge surface.
Figure 5:
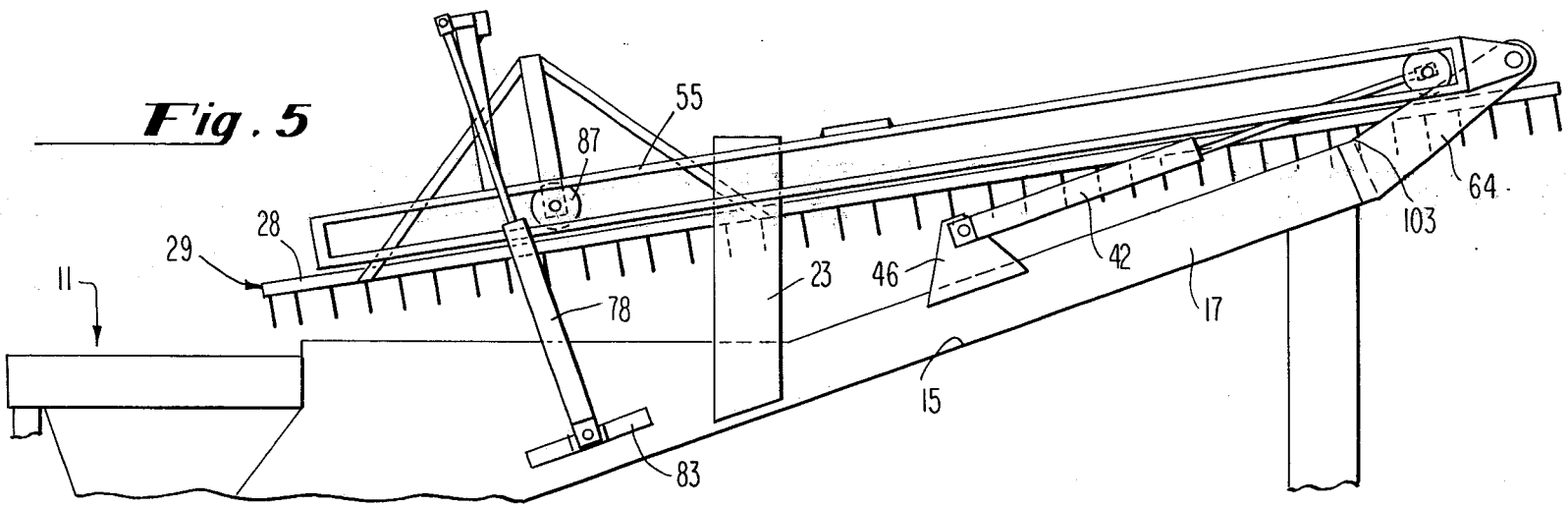
FIG. 5 is a view similar to that of FIG. 4, but with the rake not only forwardly lifted along the slope as illustrated in FIG. 4, but with the lower end of the rake in an upwardly lifted position, ready for reverse lateral movement of the rake back to the position illustrated in FIG. 2.

Similar to the cylinders 42 and 43, the cylinders 77 and 78 are provided with hydraulic delivery lines, with the lines 105 and 107 providing upward lifting, or extension of the pistons in their cylinders, in order to provide an upward pivoting of the guides 53 and 54, about their pivots 60 and 61, for example, from a lower position as illustrated in FIG. 4, to an upwardly pivoted position as illustrated in FIG. 5, after parallel movement of the guides along the chute, as takes place in movement of the rake from the position illustrated in FIG. 3 to the position illustrated in FIG. 4. It will be noted that the operation of the cylinders 77 and 78 is generally transverse to the operation of the cylinders 42 and 43, or at right angles thereto, as is more apparent with reference to FIG. 5, for example.

The rake 29 has a preferred sequence of and timing of operation. It is preferred that the rake discharge stroke, from the position illustrated in FIG. 3, to that illustrated in FIG. 4, in which particulate material 108 is discharged to another conveyor, tank or the like 110, take about 10 seconds, and operate with about four foot stroke; i.e., such that the lower end of the rake in FIG. 3 moves about 4 feet up the chute 15, to the approximate position illustrated through the lower end of the rake 29 in FIG. 4. The upward lifting of the guides 55 and 56, in a pivotal direction, from the position illustrated in FIG. 4 to that illustrated in FIG. 5, by means of actuation of the cylinders 77 and 78 in an upward lifting direction, whereupon the lower ends of the guides 55 and 56 are moved out of submersion relative to water in the well and chute should take about 3 seconds. Then the movement of the rake 29 and guides 55 and 56, and related components laterally, or backward to the postion illustrated in FIG. 2, from the position illustrated in FIG. 5 should preferably take another 3 seconds or so, and will be accomplished by energizing the cylinders 42 and 43 through their fluid supply lines 51 and 52, for return actuation.

Figure 2:
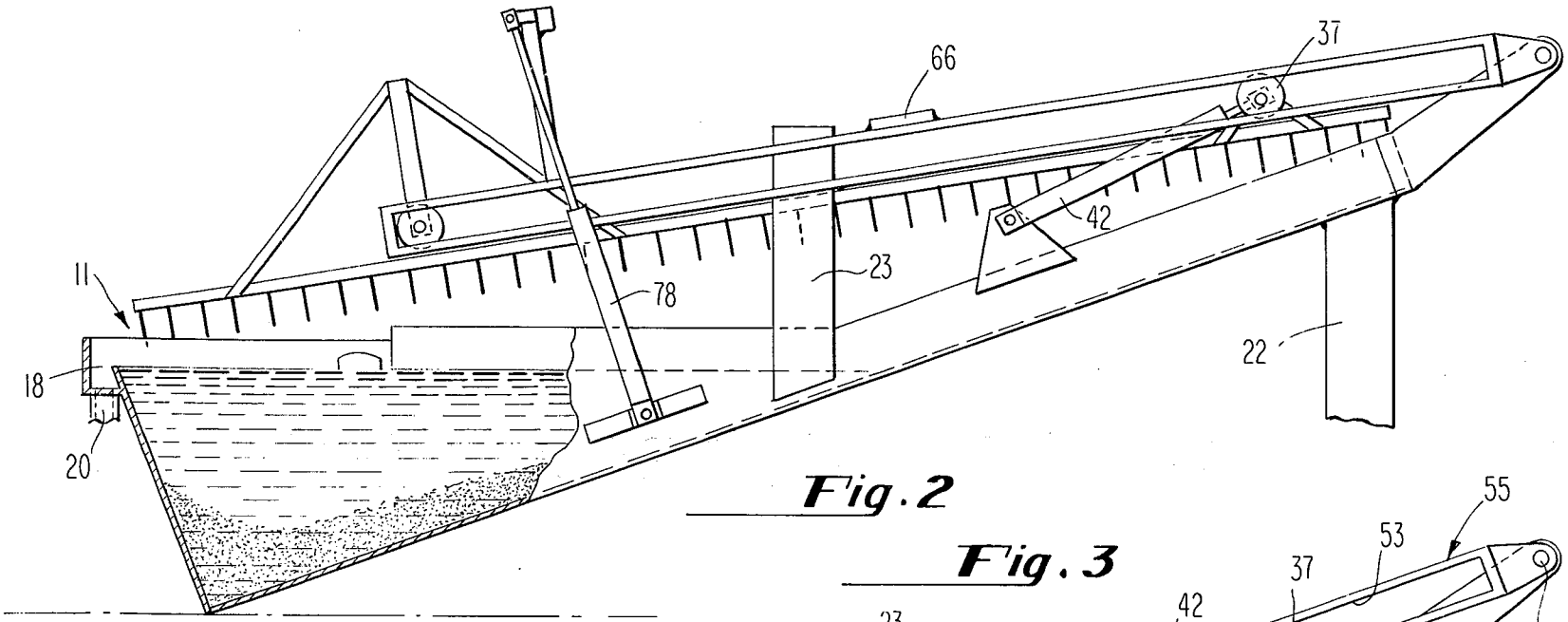
FIG. 2 is a side elevational view of the apparatus, with a portion of a well sidewall broken away for purposes of clarity, and with the rake poised above the well ready to commence its movement into the well.

In order to resume operation, the rake 29 and guides 55 and 56 and attached components would then be moved from the approximate position therefore illustrated in FIG. 2, to the position illustrated in FIG. 3, a lowering motion that again should take about 3 seconds, whereupon the rake is ready to again commence discharge of sand, by moving sand from the well 11 upwardly along the surface of the trough or chute 15.

It will be noted that for different materials, such as finer sand, coarser sand or the like, different speeds of operation will be preferable, depending upon circumstances.

A device of the present invention will ordinarily have a liquid input through the fill line 21 of about 500 gallons per minute, that will include the solids or particulate material therein, that will comprise about 45% of the input by weight. The sand or particulate material discharged therefrom, as illustrated at 108 in FIG. 4, can be on the order of about 3,600 pounds per minute, and accordingly, it will be desirable to adjust the input and output for a balanced operation, as desired. In the preferred operation disclosed above, the apparatus of the present invention is capable of three full cycles per minute.

It will thus be seen that the present apparatus is unique in that it enables a movement of the rake such that the rake undergoes no contact with the water in its return motion from the position illustrated in FIG. 5 to that illustrated in FIG. 2, and consequently there is less turbulence that might otherwise cause loss of some of the heavier sand particles out the overflow.

It will also be apparent that, of the three ways to classify that are taught herein; namely controlled inflow and outflow of water, controlled flow of water through the orifices along the sides of the slopes, and the speeding up of the operation of the machine itself, the latter classifying technique involving the speed-up of machine operation may in most instances be the least desirable because of its inherent stirring or turbulence-producing effect which tends to wash out not only some of the fines, but even some of the heavier particles. Nevertheless, for some applications, the speeding up of the process through the several stages illustrated in FIGS. 2 through 5 can provide one classifying technique.

Figure 8:
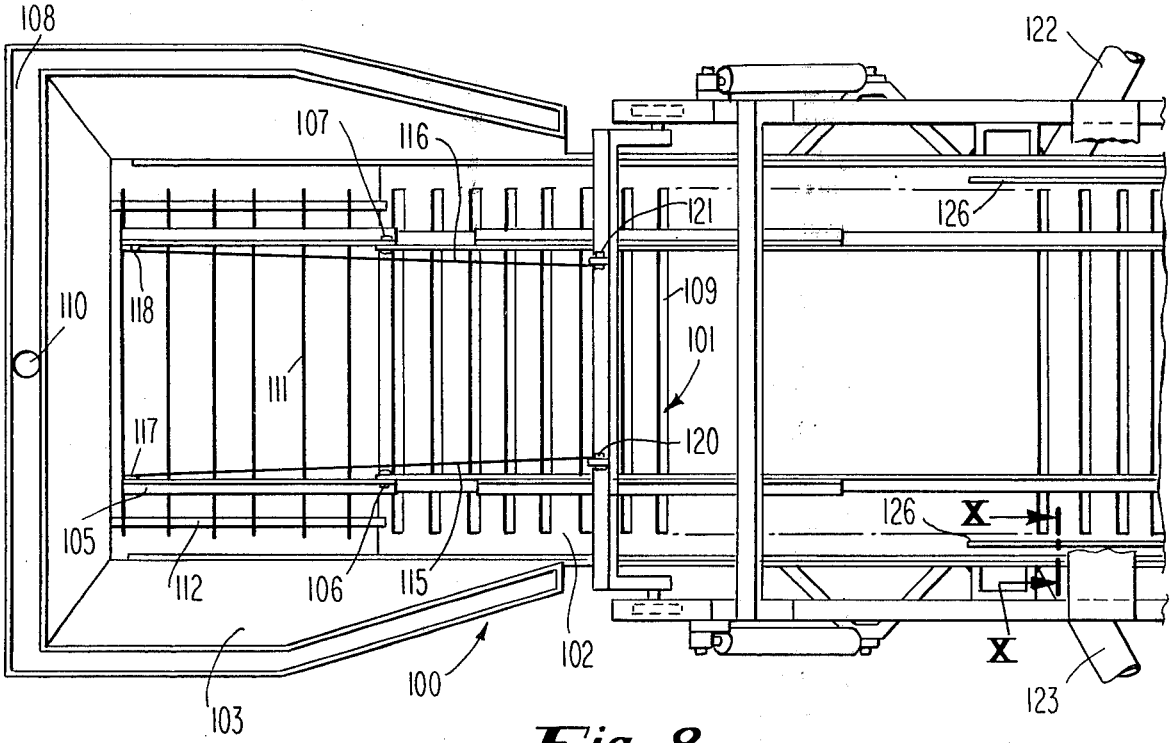
FIG. 8 is a fragmentary top plan view of an alternative embodiment of a dewatering and classifying apparatus of this invention.
Figure 9:
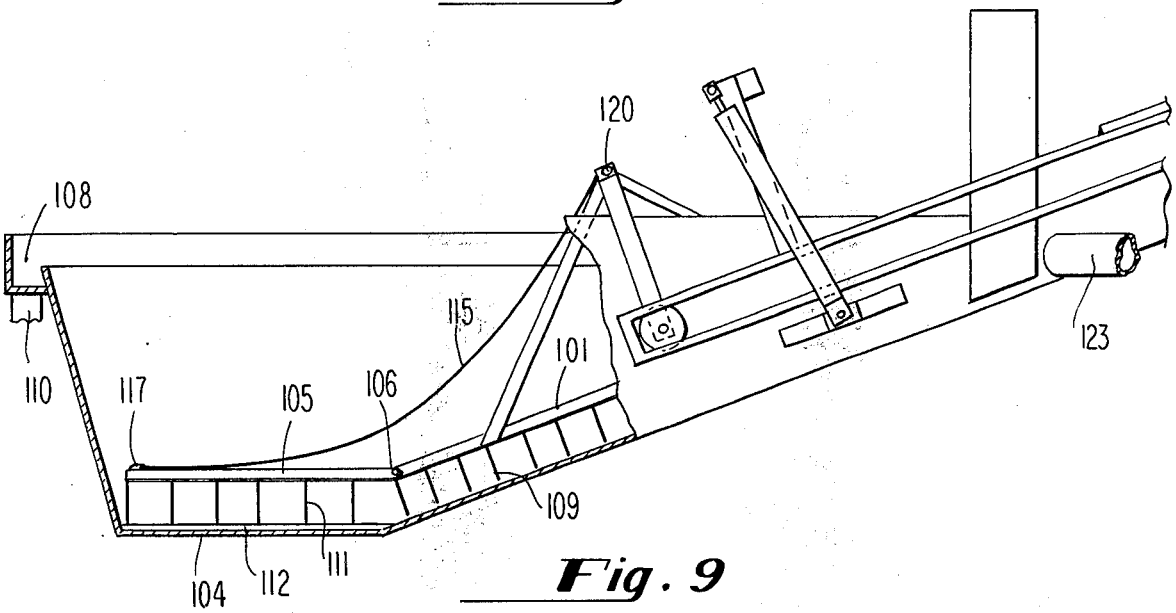
FIG. 9 is a side elevational view of the apparatus of FIG. 8, with a portion of the well sidewall broken away for purposes of clarity, illustrating a pivotally connected auxiliary rake portion, carried at the end of the main rake portion.
Figure 10:
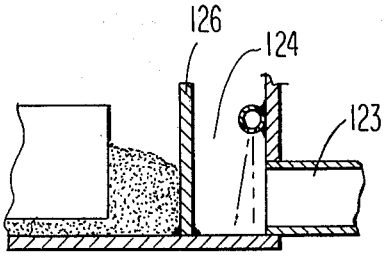
FIG. 10 is an enlarged fragmentary sectional view, taken generally along the line X—X of FIG. 8, wherein a baffle is illustrated, along with an alternative feed of water and sand to the apparatus, as a modification of the feed location illustrated in FIG. 1.

With reference now to the embodiment illustrated most specifically in FIGs. 8 through 10, an apparatus 100 is illustrated employing a rake 101 disposed for movement along a sloped chute 102, for drawing sand upwardly out of a well 103. It will be noted that the well 103 has a flat bottom portion 104, and is leftwardly extended somewhat relative to, for example, the well illustrated in FIGS. 1 through 5. This is to accommodate a rake extension 105 that is pivotally mounted at 106 and 107 to the rake 101. The other apparatus, including the lifting and moving mechanism for the rake 101 is similar to that discussed in detail with respect to the embodiment of FIGS. 1 through 5 and 7, and need not be repeated herein. Also, an overflow 108 with an overflow outlet port 110 is provided, functioning similarly to the previously discussed embodiment, and such need not be repeated herein. Rake blades 111 depend from the auxiliary or extension portion 105 of the rake of FIGS. 8 and 9, such blades 111 resting on a pair of wear strips 112 and 113, when the rake is in the positions illustrated in FIGS. 8 and 9.

The wear strips 112 and 113 are replaceable, being constructed of a softer substance than the blades 111, in order that the wear strips will wear, rather than the blade. A pair of cables 115, 116 extend from end portions 117 and 118 at which the cables 115 and 116 are coupled or connected to the auxiliary rake member 105, with opposite ends of the cables 115 and 116 being connected at 120 and 121.

It will be noted that the cables 115 and 116 are slack when the rake is in the position illustrated in FIGS. 8 and 9, about to be moved upwardly along the chute; with the main rake portion 101 being moved parallel to the slope or chute portion of the apparatus.

With the rest of the motion of the rake 101 being similar to that of the previously discussed embodiment, it will be noted that as the principal or main portion of the rake 101 nears its upper limit (not shown) of movement parallel to the chute, and commences its movement away from the chute (similar to the motion of the previously discussed embodiment from the position illustrated in FIG. 4 to that illustrated in FIG. 5), the auxiliary portion of the rake 105 which trails the rake 101, will then be generally parallel to the main rake portion 101, with the cable 115 taut, such that the entire rake (main portion 101 and auxiliary portion 105) will be moved away from the chute as the rake 101 moves just like the motion of the rake 29 discussed above, out of the water, to be returned while being held above the water (with the auxiliary portion 105 also held above the water) and then to be retracted into the water, again to the position illustrated in FIG. 9. As the auxiliary rake portion 105 is set down onto the wear strips 112 and 113, the cables 115 and 116 will again slacken as illustrated in FIG. 9.

It will further be noted that the cables 115 and 116 could be replaced with chains, sliding rods or the like, as desired, all within the essence of the embodiment illustrated in FIGS. 8 and 9.

One advantage of a larger well 103 of the type illustrated in FIGS. 8 and 9 over the well of the previously discussed embodiment is that the additional volume of water therein, and the additional bottom surface area provided by the extension portion of the well employing a flat bottom surface 104 allows additional settling, for settling fines out, to be delivered to overflow 108, and through overflow port 110. The embodiment of FIGS. 8 and 9 therefore provides a capability of substantially eliminating the necessity of preliminary settling for many applications.

The embodiment of FIGS. 8 through 10 also employs another alternative infeed of water and sand to the apparatus; namely through infeed lines 122 and 123, each angled such that water and sand flowing therethrough will be directed downwardly of the slope or chute, rather than upwardly, and thereby providing with such angled direction, a facility for directing water flow downwardly at zones 124 (see FIG. 10).

Baffles 126 are provided to prevent the inflow of water and sand from lines 122 and 123 from washing out sand being conveyed between blades 109, and also for assisting the directing of incoming sand and water down the sluiceways 124 along the sides of the chute.

It will be apparent from the foregoing that various modifications may be made in the construction of the device of the present invention, as regards structural features, and as regards connections of components to each other, all within the spirit and scope of the invention as described and claimed, to one skilled in the art. Also, various modifications are anticipated in the guiding functions, as well as in the movement mechanisms, all within the general framework or presentation of the disclosure herein. For example, modifications in the water piping may be utilized, placement of nozzles or the like, as well as overflow and well configurations and arrangements. Moreover, the discharge means, while being recited as being of the sloped type, is to be construed as being generally sloped for the purpose of accomplishing the ends of the present invention. Also, the cylinders are disclosed as being of the double-acting hydraulic type, but it is conceivable that pneumatic cylinders can be used for effecting the desired motion, although hydraulic cylinders are greatly preferred, because of their weight-lifting capabilities and general overall performance. Moreover, it is possible to provide fewer or a greater number of cylinders for movement of the rake and its guide ways in much the same manner or within the spirit and scope of this invention.

What is claimed is:

1. Apparatus for dewatering sand and like particulate material comprising well means for containing sand and water, sloped surface discharge means for conveyance of the particulate material upwardly thereof, the sloped discharge means having a lower end in said well means and an upper end disposed above said well means, rake means for discharging particulate material out of said well means up said sloped discharge means, said rake means including a moveable elongate structure having a plurality of rake blades projecting downwardly therefrom mounting means mounting said moveable elongate structure of said rake means for movement of said blades along said sloped surface discharge means in a discharging direction, and for return of said elongate structure and blades carried thereby away from said sloped discharge means and elevated relative thereto removing said elongate structure and blades carried thereby from said sand and water, and including cylinder drive means for said moveable elongate structure of said rake means, said drive means including first cylinder means operable in a direction generally parallel to said sloped discharge means for driving said rake means in a particle discharge direction alternately upwardly and downwardly along and generally parallel to said sloped discharge means, and second cylinder means operable in a direction generally transverse to said sloped discharge means for driving a lower end of said rake means alternately toward and away from an associated end of said sloped discharge means.

2. The apparatus of claim 1, wherein said mounting means includes moveable guide track means the upper end of which is pivotally mounted about a fixed pivot to the upper end of said sloped discharge means, and the lower end of which is connected to said second cylinder means for driving the lower end of said guide track means toward and away from said lower end of said sloped discharge means.

3. The apparatus of claim 2, wherein said first and second cylinder means are each of the hydraulic cylinder type.

4. The apparatus of claim 2, wherein said first cylinder means have opposite ends carried by the said discharge means and an upper end of said rake means respectively, and wherein said second cylinder means have opposite ends carried by the said discharge means and a lower end of said guide track means respectively.

5. The apparatus of claim 4, wherein guide wheels are provided carried by the upper end of said rake means and rotatively disposed within upper ends of portions of said track guide means, for rotatable guiding of said wheels therein upon activation of said first cylinder means in a particle discharge direction or the reverse, and wherein guide wheels are provided carried by the lower ends of said rake means and rotatably disposed within lower end portions of said track guide means for rotatable guiding of said wheels therein upon activation of said first cylinder means in a particle discharge direction or the converse.

6. The apparatus of claim 1, including water inlet means for facilitating the classifying of fines from heavier particulate material, of the spray type, disposed along opposite sides of said sloped discharge means, said inlet means being directed generally down said sloped discharge and providing resistance to particulate material being conveyed up said sloped discharge means, and including water and particle inlet means to said apparatus.

7. The apparatus of claim 6, wherein said water inlet means for facilitating the classifying includes valve means for adjusting and thereby varying the inflow of water to said apparatus.

8. The apparatus of claim 1, including inlet supply line means being provided for facilitating the classifying of fines from the heavier particulate material being discharged, wherein said means for facilitating the classifying comprises valve means for adjusting and thereby varying the inflow of water to said apparatus.

9. Apparatus for dewatering sand and like particulate material comprising well means for containing sand and water, sloped surface discharge means for conveyance of the particulate material upwardly thereof, the sloped discharge means having a lower end in said well means and an upper end disposed above said well means, rake means for discharging particulate material out of said well means up said sloped discharge means, said rake means including a moveable elongate structure having a plurality of rake blades projecting downwardly therefrom, mounting means mounting said moveable elongate structure of said rake means for movement of said blades along said sloped surface discharge means in a discharging direction, and for return of said elongate structure and blades carried thereby away from said sloped discharge means, and including cylinder drive means for said moveable elongate structure of said rake means, said drive means including first cylinder means operable in a direction generally parallel to said sloped discharge means for driving said rake means in a particle discharge direction alternately upwardly and downwardly along and generally parallel to said sloped discharge means, and second cylinder means operable in a direction generally transverse to said sloped discharge means for driving a lower end of said rake means alternately toward and away from an associated end of said sloped discharge means, wherein said mounting means includes guide track means the upper end of which is pivotally mounted about a fixed pivot to the upper end of said sloped discharge means, and the lower end of which is connected to said second cylinder means for driving the lower end of said guide track means toward and away from said lower end of said sloped discharge means; wherein said first cylinder means have opposite ends carried by the said discharge means and an upper end of said rake means respectively, and wherein said second cylinder means have opposite ends carried by the said discharge means and a lower end of said guide track means respectively; wherein said first and second cylinder means are each of the hydraulic cylinder type; wherein guide wheels are provided carried by the upper end of said rake means and rotatably disposed within upper ends of portions of said track guide means, for rotatable guiding of said wheels therein upon activation of said first cylinder means in a particle discharge direction or the reverse, and wherein guide wheels are provided carried by the lower end portions of said track guide means for rotatable guiding of said wheels therein upon activation of said first cylinder means in a particle discharge direction or the converse; including water inlet means along opposite sides of said sloped discharge means, and with means being provided for adjustably facilitating the classifying of the particulate material.

10. The apparatus of claim 1, including auxiliary rake means also mounted for elevated return movement relative to sand and water in said well means, said auxiliary rake means being pivotally carried by a lower end of said rake means, for disposition along the bottom of said well means, and with means connecting the auxiliary rake means to said rake means for limiting the downward pivoting of said auxiliary rake means when the lower end of said rake means is being driven away from an associated end of said sloped discharge means by said second cylinder means.

11. The apparatus of claim 10, wherein said well means has a generally flat horizontally disposed bottom.

12. The apparatus of claim 1, including inlet means located at an upper sloped position of said sloped discharge means, for water and sand along sides of said sloped discharge means, said inlet means being sloped to deliver water and sand in a downward direction of said sloped discharge means, and including baffle means separating said inlet means from said rake means.

* * * * *